US010410805B1

(12) United States Patent
Chen et al.

(10) Patent No.: US 10,410,805 B1
(45) Date of Patent: Sep. 10, 2019

(54) KEY STRUCTURE

(71) Applicant: Acer Incorporated, New Taipei (TW)

(72) Inventors: Hung-Chi Chen, New Taipei (TW); Ching-Piao Kuan, New Taipei (TW); Yi-Hsuan Yang, New Taipei (TW); Chi-Hung Lai, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/033,225

(22) Filed: Jul. 12, 2018

(30) Foreign Application Priority Data

Apr. 11, 2018 (TW) ..... 107204701 U

(51) Int. Cl.
*H01H 13/14* (2006.01)
*H01H 13/20* (2006.01)
*H01H 13/70* (2006.01)

(52) U.S. Cl.
CPC ..... *H01H 13/14* (2013.01); *H01H 13/20* (2013.01); *H01H 13/70* (2013.01); *H01H 2233/07* (2013.01)

(58) Field of Classification Search
CPC .... H01H 13/14; H01H 13/20; H01H 2233/07; H01H 13/70; H01H 13/7065; H01H 13/7073
See application file for complete search history.

(56) References Cited

U.S. PATENT DOCUMENTS

| | | | | |
|---|---|---|---|---|
| 8,759,705 | B2 | 6/2014 | Funakoshi et al. | |
| 2003/0209416 | A1* | 11/2003 | Tsai | H01H 13/14 200/341 |
| 2004/0178051 | A1* | 9/2004 | Sato | H01H 3/125 200/344 |
| 2014/0299457 | A1* | 10/2014 | So | H01H 13/76 200/5 A |

FOREIGN PATENT DOCUMENTS

| | | |
|---|---|---|
| CN | 205384962 | 7/2016 |
| TW | M527986 | 9/2016 |

* cited by examiner

*Primary Examiner* — Ahmed M Saeed
*Assistant Examiner* — Lheiren Mae A Caroc
(74) *Attorney, Agent, or Firm* — JCIPRNET

(57) ABSTRACT

The invention provides a key structure, which includes a carrying plate, a trigger member, a keycap, and a reciprocating member. The trigger member is disposed on the carrying plate, and includes a bearing portion, a pillar portion, a trigger portion and a connecting portion. The bearing portion and the trigger portion are respectively disposed at two opposite sides of the pillar portion, and the pillar portion is perpendicular to the carrying plate. The trigger portion protrudes toward the carrying plate. The connecting portion is circularly disposed at one side of the pillar portion facing the carrying plate, extends from the pillar portion toward the carrying plate, and is obliquely connected to the carrying plate. The keycap is disposed on the bearing portion. The reciprocating member comprises two opposite ends respectively connected to the carrying plate and the keycap.

5 Claims, 5 Drawing Sheets

KEY STRUCTURE

CROSS-REFERENCE TO RELATED APPLICATION

This application claims the priority benefit of Taiwan application serial no. 107204701, filed on Apr. 11, 2018. The entirety of the above-mentioned patent application is hereby incorporated by reference herein and made a part of this specification.

BACKGROUND OF THE INVENTION

1. Field of the Invention

The invention relates to a key structure and more particularly to the key structure of a keyboard.

2. Description of Related Art

Personal desktop computers and notebook computers have become indispensable tools for modern people. Users nowadays have increasing demands in terms of the specification and the tactile feedbacks of the keyboards, which are used as physical input interfaces for personal desktop computers and notebook computers. On the other hand, the weight, the thickness and the price are also the main considerations when consumers buy the keyboards.

For instance, mechanical keyboards can provide solid tactile feedbacks but their high price and thicker thickness are still problems to be considered. Also, some consumers may not like noise made when keys are pressed. Compared to the mechanical keyboards, membrane keyboards may have lower manufacturing cost and substantially reduced thickness, but fail to deliver solid tactile feedbacks for users. Moreover, when pressing down the membrane keyboards, the rubber domes of the membrane keyboards would experience an instant collapse. The consumers may not like or even be bothered by the audible click sounds and the tactile bump feedback brought by the instant collapses of the rubber domes. For example, in a shooting game, the shooting speed may be affected by the tactile bump feedback of the key structure, and players may have a poor gaming experience owing to the reduced shooting speed.

Therefore, it is obvious that the mechanical keyboards with thicker thickness are not suitable for the keyboard to be disposed on a thin and light weight device such as a notebook computer. On the other hand, although the membrane keyboards are relatively light and thin, their functions are more limited. In order to remove the tactile bump feedback, reduce the audible click sounds and maintain a slim size, it is required to design an innovative key structure.

SUMMARY OF THE INVENTION

The invention provides a key structure, which can provide solid tactile feedbacks, reduced audible click sounds, a low manufacturing cost and a substantially reduced thickness.

The key structure of the invention includes a carrying plate, a trigger member, a keycap, and a reciprocating member. The trigger member is disposed on the carrying plate, and includes a bearing portion, a pillar portion, a trigger portion and a connecting portion. The bearing portion and the trigger portion are respectively disposed at two opposite sides of the pillar portion. The pillar portion is perpendicular to the carrying plate. The trigger portion protrudes toward the carrying plate and is configured to trigger a trigger contact on the carrying plate. The connecting portion is circularly disposed at one side of the pillar portion facing the carrying plate, and the connecting portion extends from the pillar portion toward the carrying plate and is obliquely connected to the carrying plate. The keycap is disposed on the bearing portion. Two reciprocating member includes two opposite ends respectively connected to the carrying plate and the keycap, and is configured to guide a movement direction of the keycap. During a process of pressing the keycap from a first position at which no force is applied to a second position at which the keycap is fully pressed down, the trigger member does not experience an instant collapse and therefore does not produce an audible click sound nor a tactile bump feedback.

In the key structure of the invention, a distance between a top surface of the keycap and a bottom surface of the carrying plate is less than 6 millimeters, and a vertical distance between the first position and the second position is greater than 2 millimeters.

In the key structure of the invention, the trigger member further includes a first annular protrusion and a second annular protrusion disposed on and surrounding the periphery of the pillar portion.

The key structure of the invention includes a carrying plate, a trigger member, a keycap, an elastic member and a reciprocating member. The trigger member is disposed on the carrying plate, and includes a bearing portion, a trigger portion and a connecting portion. Here, the trigger portion is connected to the bearing portion, and the trigger portion is disposed between the bearing portion and the carrying plate. The trigger portion protrudes toward the carrying plate and is configured to trigger a trigger contact on the carrying plate. The connecting portion is circularly disposed at one side of the bearing portion facing the carrying plate, wherein the connecting portion extends from the bearing portion toward the carrying plate and is obliquely connected to the carrying plate. The keycap is disposed on the bearing portion. Here, a groove is disposed on the bearing portion and faces the keycap. The elastic member includes a first end inserted within the groove and a second end connected to the keycap. The reciprocating member includes two opposite ends respectively connected to the carrying plate and the keycap, and is configured to guide a movement direction of the keycap. During a process of pressing the keycap from a first position at which no force is applied to a second position at which the keycap is fully pressed down, the trigger member does not experience an instant collapse and therefore does not produce an audible click sound nor a tactile bump feedback.

In the key structure of the invention, a distance between a top surface of the keycap and a bottom surface of the carrying plate is less than 6 millimeters, and a vertical distance between the first position and the second position is greater than 2 millimeters.

In the key structure of the invention, the bearing portion further includes a limiting protrusion disposed within the groove and protruding toward the keycap, and the first end of the elastic member inserted within the groove is sleeved on the limiting protrusion.

In the key structure of the invention, the elastic member is a compression spring.

Based on the above, by adopting the trigger member (e.g., a rubber dome) to trigger the thin film circuit, the key structure of the invention can achieve a substantially reduced thickness and a low manufacturing cost. On the other hand, by improving the structural design of the trigger member and optionally cooperating the trigger member with the elastic member (e.g., a compression spring), the users can get solid tactile feedbacks when pressing down the key structure. Moreover, the trigger member (i.e., the rubber dome) may also not produce audible click sounds by avoiding the instant collapse.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
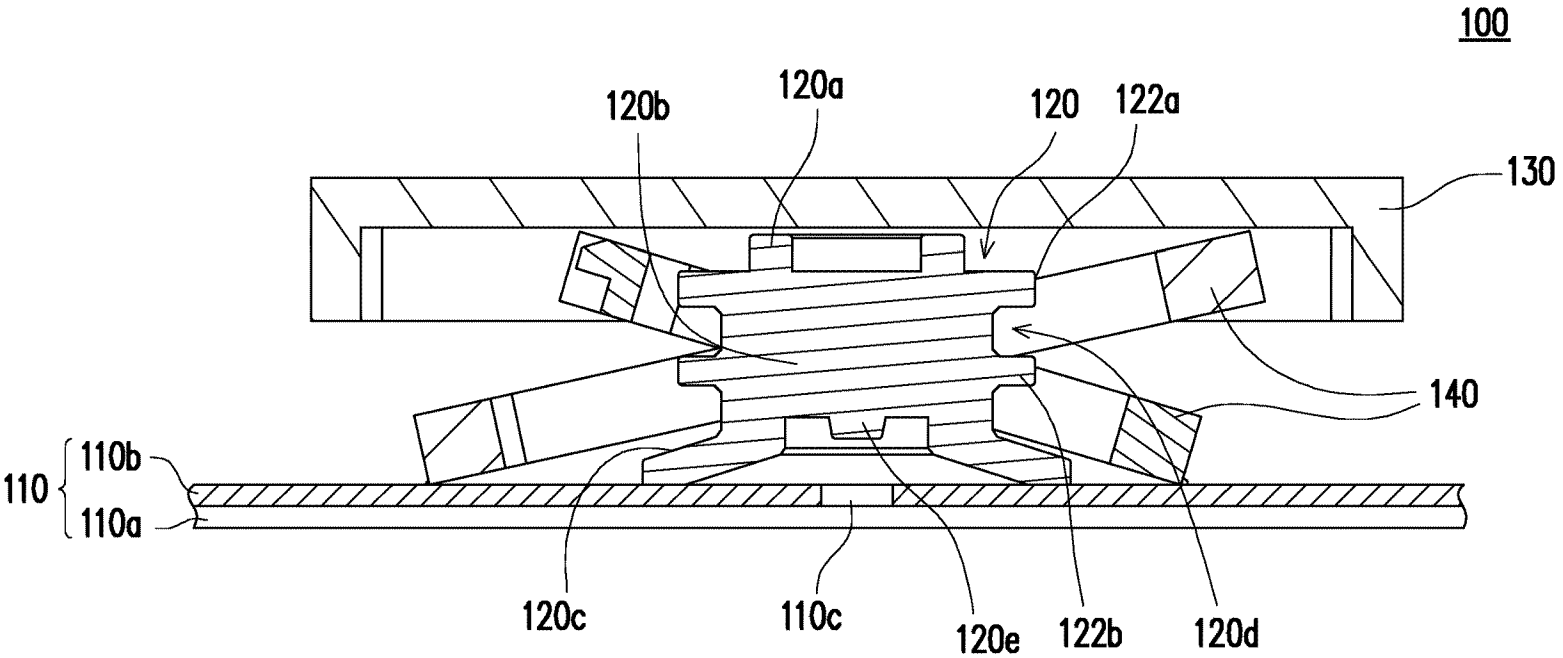
FIG. 1*a* is a schematic diagram of a key structure in an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
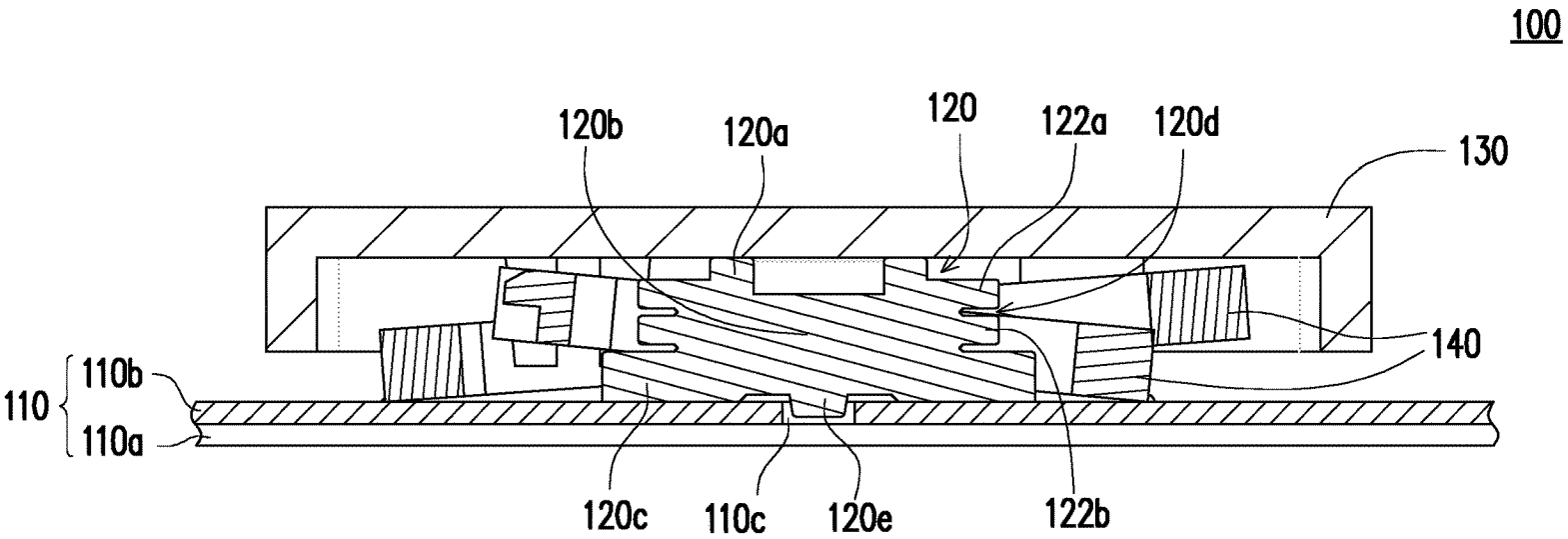
FIG. 1*b* is a schematic diagram showing a keycap of FIG. 1*a* moved to a second position.
Figure 2:
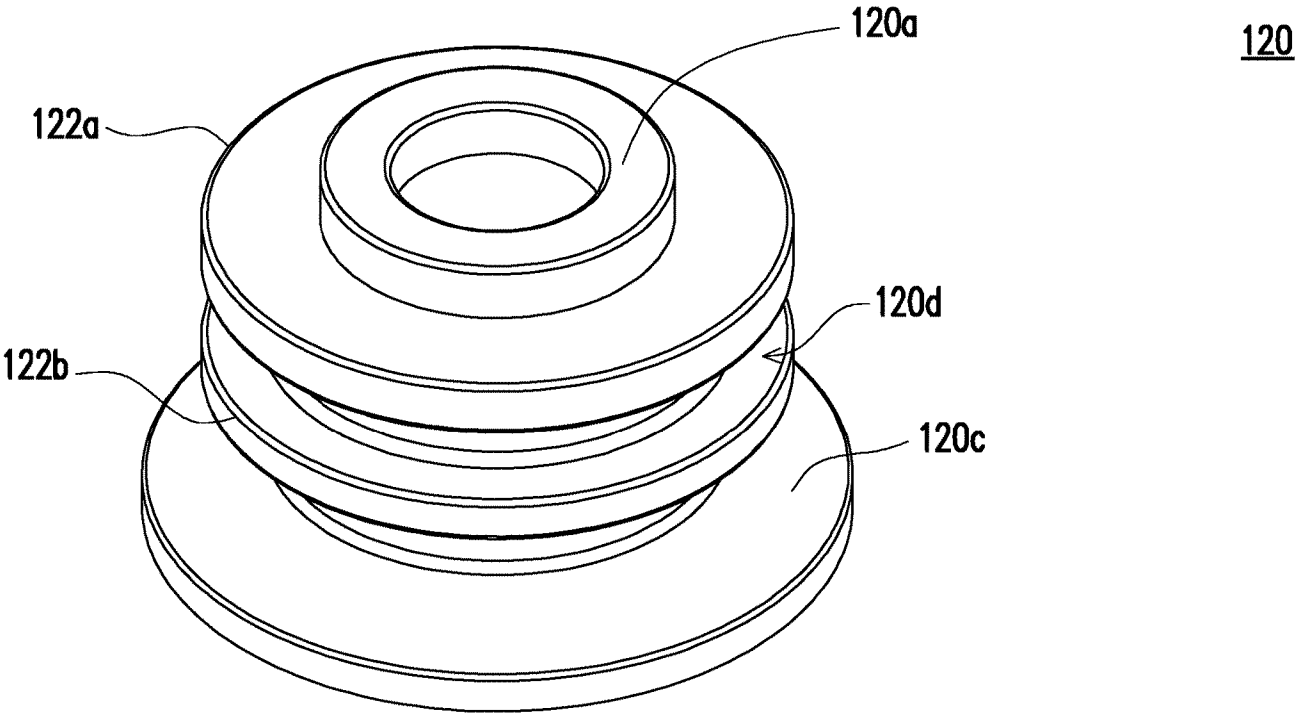
FIG. 2 is a schematic diagram of a trigger member of FIG. 1*a*.

FIG. 1*a* is a schematic diagram of a key structure in an embodiment of the invention. FIG. 1*b* is a schematic diagram showing a keycap of FIG. 1*a* moved to a second position. FIG. 2 is a schematic diagram of a trigger member of FIG. 1*a*. With reference to FIG. 1*a*, FIG. 1*b* and FIG. 2, in this embodiment, a key structure 100 includes a carrying plate 110, a trigger member 120, a keycap 130 and a reciprocating member 140. Among them, the carrying plate 110 includes a substrate 110*a* and a thin film circuit 110*b* placed on the substrate 110*a*, and the thin film circuit 110*b* is disposed with a trigger contact 110*c* corresponding to the trigger member 120 to generate electric signals after being triggered by the trigger member 120. Although the present embodiment describes the thin film circuit 110*b* placed on the substrate 110*a*, the invention is not limited thereto. In other embodiments, the substrate may be placed on the thin-film circuit, and the substrate may be disposed with a through hole on a region corresponding to the trigger contact of the thin film circuit. Therefore, a portion of the trigger member can trigger the trigger contact of the thin film circuit through the through hole.

In this embodiment, the carrying plate 110 is configured to carry the trigger member 120, the keycap 130 and the reciprocating member 140. The trigger member 120 is disposed on the carrying plate 110, and may adopt a rubber dome or a dome structure fabricated by using materials like silicone, etc. More specifically, the trigger member 120 includes a bearing portion 120*a*, a pillar portion 120*b*, a connecting portion 120*c*, a first annular protrusion 122*a*, a second annular protrusion 122*b* and a trigger portion 120*e*. The keycap 130 is disposed on the trigger member 120 and abuts against the bearing portion 120*a*. The bearing portion 120*a* and the trigger portion 120*e* are respectively disposed at two opposite sides of the pillar portion 120*b*, and the pillar portion 120*b* is perpendicular to the carrying plate 110. In other words, an extending direction of the pillar portion 120*b* is substantially perpendicular to the carrying plate 110.

For instance, the pillar portion 120*b* may be a cylindrical structure, and the bearing portion 120*a* may be a protruding ring extends from the pillar portion 120*b* toward the keycap 130. On the other hand, the trigger portion 120*e* may be a protruding pillar extends from the pillar portion 120*b* toward the carrying plate 110. However, when the key structure 100 is not pressed, the trigger portion 120*e* maintains a distance without contacting the carrying plate 110. In this embodiment, the pillar portion 120*b* may be a solid cylindrical structure. In other embodiments, based on the degree of the deformation, tactile feedbacks or other design considerations, the pillar portion may be designed as a hollow cylindrical structure. The invention is not limited in this regard. The first annular protrusion 122*a* and the second annular protrusion 122*b* are disposed on and surrounds the periphery of the pillar portion 120*b* with a suitable spacing (e.g., disposed in parallel), and an annular groove 120*d* is defined between the two protrusions. In other embodiments, other annular protrusions may be further added.

The trigger portion 120*e* protrudes toward the carrying plate 110, and is aligned with the trigger contact 110*c* of the thin film circuit 110*b*. For instance, a distance between a top surface of the keycap 130 and a bottom surface of the carrying plate 110 may be set to 5.5 millimeters, so as to provide a press stroke length of approximately 2.5 millimeters. With reference to FIG. 1*a* and FIG. 1*b*, the press stroke length refers to a vertical distance between a first position (a location of the keycap 130 shown in FIG. 1*a*) at which no force is applied on the keycap 130 and a second position (a location of the keycap 130 shown in FIG. 1*b*) at which the keycap 130 is fully pressed down by the user. Here, the keycap 130 at the second position is closer to the carrying plate 110 than the keycap 130 at the first position. Compared to the above, the existing mechanical keyboards need to have a thickness of approximately 10 millimeters or more in order to provide the same press stroke length. Therefore, the key structure 100 can still provide a sufficient press stroke length while thinning the thickness. Furthermore, in a condition where the distance between the top surface of the keycap 130 and the bottom surface of the carrying plate 110 is 5 to 6 millimeters, the press stroke length can still achieve 2 to 3 millimeters to thereby improve the required tactile feedback. More specifically, the press stroke length of the key structure 100 is determined by a distance between the trigger portion 120*e* and the trigger contact 110*c* of the thin film circuit 110*b* and a deformation of the trigger member 120 when pressed by a force. If the trigger member 120 is able to produce an elastic deformation after being applied with a force, a desired tactile feedback may be provided to the users.

In this embodiment, the reciprocating member 140 adopts a scissors structure formed by two racks staggered with each other, and the two racks are pivoted to each other. The reciprocating member 140 comprises two ends respectively connected to the carrying plate 110 and the keycap 130, and is configured to guide the keycap 130 being pressed by a force and the trigger member 120 to move straight down along a direction perpendicular to the carrying plate 110, or guide the trigger member 120 with the restored elasticity and the keycap 130 driven by the trigger member 120 to move straight up along the direction perpendicular to the carrying plate 110. On the other hand, based on the structure design of the pillar portion 120*b* and the cooperation between first annular protrusion 122*a* and the second annular protrusion 122*b* disposed side by side on the periphery of the pillar portion 120*b*, a more solid tactile feedback may be provided when the user presses down the key structure 100.

More specifically, the first annular protrusion 122*a* and the second annular protrusion 122*b* adjacent to each other belong to one of the factors for determining an elastic deformation amount of the trigger member 120. For instance, when the trigger member 120 is pressed, the first annular protrusion 122*a* and the second annular protrusion 122*b* adjacent to each other would move close to each other such that a width of the annular groove 120*d* is reduced accordingly. Here, the reduction in the width of the annular groove 120*d* is one of components of the elastic deformation amount of the trigger member 120. Furthermore, because the first annular protrusion 122*a* and the second annular protrusion 122*b* in cooperation with the pillar portion 120*b* are structurally similar to a bellows, the overall structure may be more flexible. Therefore, when the user releases the force applied on the key structure 100, said bellows-like structure can help the trigger member 120 to restore to its original position.

On the other hand, the trigger member 120 further includes the connecting portion 120*c* extending from the pillar portion 120*b* toward the carrying plate 110. Here, the connecting portion 120*c* is circularly disposed at one side of the pillar portion 120*b* facing the carrying plate 110, and obliquely connected to the carrying plate 110. Here, the connecting portion 120*c* is substantially in a form of a cone structure. The connecting portion 120*c* is configured to keep a distance between the trigger portion 120*e* and the carrying plate 110. When the trigger member 120 is pressed, the connecting portion 120*c* would be deformed accordingly. However, the distance between the trigger portion 120*e* and the carrying plate 110 may be reduced by properly designing an included angle between the connecting portion 120*c* and the carrying plate 110 so as to prevent the connecting portion 120*c* from experiencing an instant collapse. The audible click sound and the tactile bump feedback brought by the instant collapse may therefore be eliminated.

In contrast, the rubber dome in the existing keyboard structure has a longer distance between the trigger portion and the thin film circuit. In other words, because a part of the rubber dome covered on the thin film circuit in the existing keyboard structure is almost a hollow structure, the rubber dome in the existing keyboard structure can easily generate audible click sounds and tactile bump feedbacks due to the instant collapse when pressed.

An elastic structure of the trigger member 120 allows the key structure 100 to keep the sufficient press stroke length under a limited height (or thickness). In addition, when the user presses down the key structure 100, the key structure 100 can make the keycap 130 to go down smoothly through the deformations of the bearing portion 120*a*, the pillar portion 120*b*, the connecting portion 120*c*, the first annular protrusion 122*a* and the second annular protrusion 122*b*. The trigger member 120 and other components of the key structure 100 would not generate the audible click sound and the tactile bump feedback because none of the components would experience the instant collapse.

Figure 3:
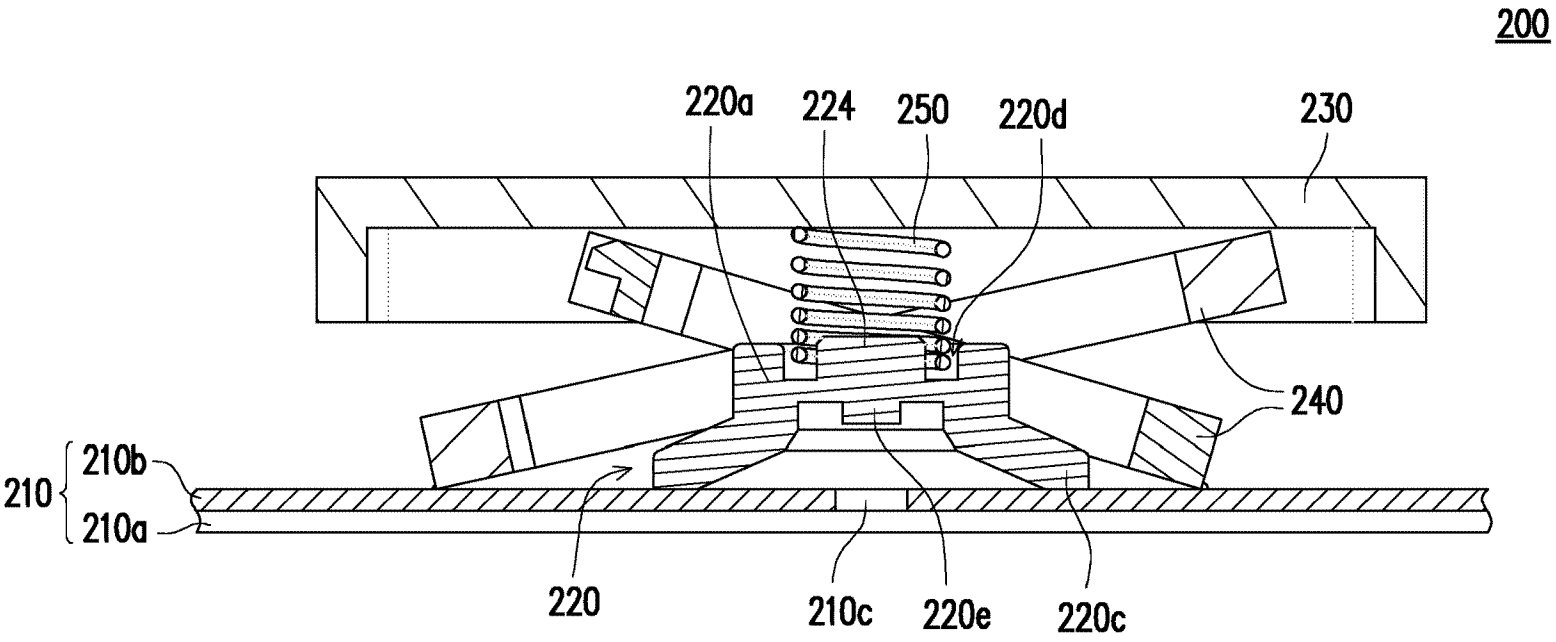
FIG. 3 is a schematic diagram of a key structure in another embodiment of the invention.
Figure 4:
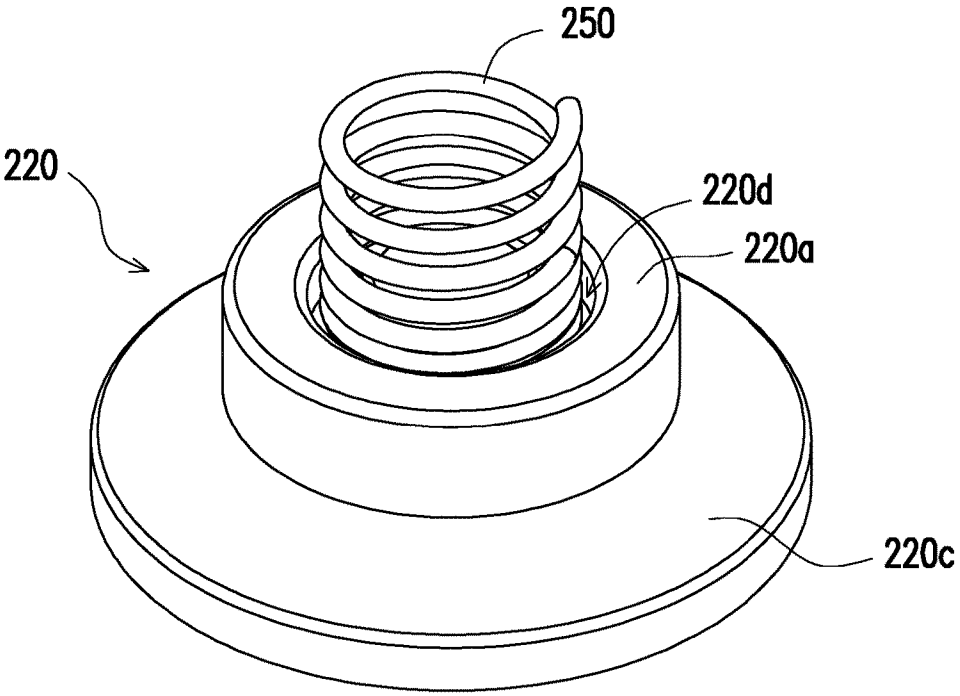
FIG. 4 is a schematic diagram of a trigger member and an elastic member of FIG. 3.

FIG. 3 is a schematic diagram of a key structure in another embodiment of the invention. FIG. 4 is a schematic diagram of a trigger member and an elastic member of FIG. 3. With reference to the embodiment in FIGS. 3 and 4, a key structure 200 includes a carrying plate 210, a trigger member 220, a keycap 230, a reciprocating member 240 and an elastic member 250. Among them, the carrying plate 210 includes a substrate 210*a* and a thin film circuit 210*b* placed on the substrate 210*a*, and the thin film circuit 210*b* is disposed with a trigger contact 210*c* corresponding to the trigger member 220 to generate electric signals after being triggered by the trigger member 220. Although the present embodiment describes the thin film circuit 210*b* placed on the substrate 210*a*, the invention is not limited thereto. In other embodiments, the substrate may be placed on the thin-film circuit, and the substrate may be disposed with a through hole on a region corresponding to the trigger contact of the thin film circuit. Therefore, a portion of the trigger member can trigger the trigger contact of the thin film circuit through the through hole.

The carrying plate 210 is configured to carry the trigger member 220, the keycap 230, the reciprocating member 240 and the elastic member 250. The trigger member 220 is disposed on the carrying plate 210, and may adopt a rubber dome or a dome structure fabricated by using materials like silicone, etc. On the other hand, the elastic member 250 is disposed between the trigger member 220 and the keycap 230, and may adopt a compression spring or other components that can provide an elastic recovery force after being compressed. More specifically, the trigger member 220 includes a bearing portion 220*a*, a connecting portion 220*c*, a trigger portion 220*e* and a limiting protrusion 224. The trigger portion 220*e* is connected to the bearing portion 220*a*, and the trigger portion 220*e* is disposed between the bearing portion 220*a* and the carrying plate 210. The trigger portion 220*e* protrudes toward the carrying plate 210 and is configured to trigger a trigger contact 210*c* on the carrying plate 210.

On the other hand, a groove 220*d* is disposed on the bearing portion 220*a* and faces the keycap 230. The elastic member 250 includes a first end inserted within the groove 220*d* and a second end connected to the keycap 230. The limiting protrusion 224 protrudes from the bearing portion 220*a* toward the keycap 230 and is disposed within the groove 220*d* to define the annular groove. More specifically, one end of the elastic member 250 inserted within the groove 220*d* is sleeved on the limiting protrusion 224. Accordingly, the elastic member 250 may be prevented from being disengaged from the bearing portion 220*a*.

The trigger portion 220*e* is connected to the bearing portion 220*a*. The trigger portion 220*e* protrudes toward the carrying plate 210, and is aligned with a protruded pillar of the trigger contact 210*c* of the thin film circuit 210*b*. For instance, a distance between a top surface of the keycap 230 and a bottom surface of the carrying plate 210 may be set to 5.5 millimeters only, so as to provide a press stroke length of approximately 2.5 millimeters. The press stroke length refers to a vertical distance between a first position (a location of the keycap 230 shown in FIG. 3) at which no force is applied on the keycap 230 and a second position (not shown in the figures, but similar to the position in FIG. 1*b*) at which the keycap 230 is fully pressed down by the user. Here, the keycap 230 at the second position is closer to the carrying plate 210 than the keycap 230 at the first position. Compared to the existing mechanical keyboards, the key structure 200 can still have the sufficient press stroke length while thinning the thickness. For example, in a condition where the distance between the top surface of the keycap 230 and the bottom surface of the carrying plate 210 is 5 to 6 millimeters, the press stroke length can still achieve 2 to 3 millimeters to improve tactile feedbacks. Specifically, the press stroke length of the key structure 200 is determined by a distance between the trigger portion 220*e* and the trigger contact 210*c* of the thin film circuit 210*b*, a deformation amount of the trigger member 220 when being pressed by a force and a deformation amount of the elastic member 250 when being pressed by a force. If the trigger member 220 and the elastic member 250 are able to produce an elastic deformation after being applied with force, a desired tactile feedback may be provided to the users.

Furthermore, the elastic member 250 is one of the factors for determining the press stroke length of the key structure 200. For instance, when the key structure 200 is pressed by a force, the elastic member 250 produces the elastic deformation. At the same time when a pitch of the pressed elastic member 250 is reduced, the user would need to apply a greater force so the elastic member 250 can remain deformed. Relatively, the user can get the feedback of the more solid tactile feedback. When the user releases force applied to the key structure 200, the elastic recovery force of the elastic member 250 can drive the keycap 230 back to its original position, that is, the location at which no force is applied.

In this embodiment, the reciprocating member 240 adopts a scissors structure formed by two racks staggered with each other, and the two racks are pivoted to each other. The reciprocating member 240 comprises two opposite ends respectively connected to the carrying plate 210 and the keycap 230, and is configured to guide the keycap 230 being pressed by a force, the elastic member 250 and the trigger member 220 to move straight down along a direction perpendicular to the carrying plate 210, or guide the trigger member 220 with the restored elasticity, the elastic member 250 with elasticity restored and the keycap 230 driven by the trigger member 220 and the elastic member 250 to move straight up along the direction perpendicular to the carrying plate 210. On the other hand, based on the cooperation between the elastic member 250 and the trigger member 220, a more solid tactile feedback may be provided when the user presses down the key structure 200.

On the other hand, the trigger member 220 further includes the connecting portion 220*c* extended from the bearing portion 220*a*. Here, the connecting portion 220*c* is circularly disposed at one side of the bearing portion 220*a* facing the carrying plate 210, and obliquely connected to the carrying plate 210. Here, the connecting portion 220*c* is substantially in a form of a cone structure. The connecting portion 220*c* is configured to keep a distance between the trigger portion 220*e* and the carrying plate 210. When the trigger member 220 is pressed by a force, the connecting portion 220*c* would be deformed accordingly. However, the distance between the trigger portion 220*e* and the carrying plate 210 may be reduced by properly designing an included angle between the connecting portion 220*c* and the carrying plate 210 so as to prevent the connecting portion 220*c* from experiencing an instant collapse. The audible click sound and the tactile bump feedback brought by the instant collapse may therefore be eliminated.

An elastic structure composed of the trigger member 220 and the elastic member 250 allows the key structure 200 to still keep the sufficient press stroke length under a limited height (or thickness). In addition, when the user presses down the key structure 200, the key structure 200 can make the keycap 230 to go down smoothly through the deformations of the bearing portion 220*a*, the elastic member 250 and the connecting portion 230. The trigger member 220 and other components of the key structure 200 would not generate the audible click sound and the tactile bump feedback because none of the components would experience the instant collapse.

In summary, by adopting the trigger member (e.g., a rubber dome) to trigger the thin film circuit, the key structure of the invention can achieve substantially reduced thickness and low manufacturing cost. On the other hand, by improving the structural design of the trigger member and optionally cooperating the trigger member with the elastic member (e.g., a compression spring), the users can get solid tactile feedback when pressing down the key structure. Moreover, the trigger member (i.e., the rubber dome) may also not generate audible click sounds by avoiding the instant collapse.

Although the invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

What is claimed is:

1. A key structure, comprising:

a carrying plate;

a trigger member, disposed on the carrying plate and comprising a bearing portion, a pillar portion, a trigger portion, a connecting portion, a first annular protrusion and a second annular protrusion, wherein the bearing portion and the trigger portion are respectively disposed at two opposite sides of the pillar portion, the pillar portion is perpendicular to the carrying plate, the trigger portion protrudes toward the carrying plate and is configured to trigger a trigger contact on the carrying plate, the connecting portion is circularly disposed at one side of the pillar portion facing the carrying plate, the connecting portion extends from the pillar portion toward the carrying plate and is obliquely connected to the carrying plate, and the first annular protrusion and the second annular protrusion are disposed on and surround the periphery of the pillar portion;

a keycap, disposed on the bearing portion; and a reciprocating member, comprising two opposite ends respectively connected to the carrying plate and the keycap, and configured to guide a movement direction of the keycap, wherein during a process of pressing the keycap from a first position at which no force is applied to a second position at which the keycap is fully pressed down, the trigger member does not experience an instant collapse and therefore does not produce an audible click sound nor a tactile bump feedback.

2. The key structure according to claim 1, wherein a distance between a top surface of the keycap and a bottom surface of the carrying plate is less than 6 millimeters, and a vertical distance between the first position and the second position is greater than 2 millimeters.

3. A key structure, comprising:

a carrying plate;

a trigger member, disposed on the carrying plate and comprising a bearing portion, a trigger portion and a connecting portion, wherein the trigger portion is connected to the bearing portion, the trigger portion is disposed between the bearing portion and the carrying plate, the trigger portion protrudes toward the carrying plate and is configured to trigger a trigger contact on the carrying plate, the connecting portion is circularly disposed at one side of the bearing portion facing the carrying plate, and the connecting portion extends from the bearing portion toward the carrying plate and is obliquely connected to the carrying plate;

a keycap, disposed on the bearing portion, wherein a groove is disposed on the bearing portion and faces the keycap, and the bearing portion comprises a limiting protrusion disposed within the groove and protruding toward the keycap;

an elastic member, comprising a first end inserted within the groove and a second end connected to the keycap, wherein the first end of the elastic member inserted within the groove is sleeved on the limiting protrusion;

a reciprocating member, comprising two opposite ends respectively connected to the carrying plate and the keycap, and configured to guide a movement direction of the keycap, wherein during a process of pressing the keycap from a first position at which no force is applied to a second position at which the keycap is fully pressed down, the trigger member does not experience an instant collapse and therefore does not produce an audible click sound nor a tactile bump feedback.

4. The key structure according to claim 3, wherein a distance between a top surface of the keycap and a bottom surface of the carrying plate is less than 6 millimeters, and a vertical distance between the first position and the second position is greater than 2 millimeters.

5. The key structure according to claim 3, wherein the elastic member is a compression spring.

* * * * *